US005996862A

United States Patent [19]

Peruzzo et al.

[11] Patent Number: 5,996,862

[45] Date of Patent: Dec. 7, 1999

[54] DEVICE FOR SUSPENDING PANTS AND SIMILAR GARMENTS FOLDABLE IN TWO PARTS

[75] Inventors: Roberto Peruzzo, Valdagno; Bernardino Parise, Marostica, both of Italy

[73] Assignee: Mainetti Tecnologie S.p.A., Castelgomberto, Italy

[21] Appl. No.: 09/239,105

[22] Filed: Jan. 28, 1999

[30] Foreign Application Priority Data

Feb. 6, 1998 [IT] Italy ..... VI98A0023

[51] Int. Cl.[6] ..... A47G 25/15; A47G 25/14

[52] U.S. Cl. ..... 223/95; 223/94; 223/89

[58] Field of Search ..... 223/85, 88, 89, 223/94, 95, 96

[56] References Cited

U.S. PATENT DOCUMENTS

| | | | |
|---|---|---|---|
| 1,971,794 | 8/1934 | Panettiere | 223/96 |
| 2,222,232 | 1/1940 | McOsker | 223/96 |
| 5,178,306 | 1/1993 | Petrou | 223/96 |
| 5,297,706 | 3/1994 | Blitz | 223/96 |
| 5,775,554 | 7/1998 | Taylor | 223/96 |
| 5,806,728 | 9/1998 | Forsstrom | 223/96 |

*Primary Examiner*—Bibhu Mohanty
*Attorney, Agent, or Firm*—Bucknam and Archer

[57] ABSTRACT

The device for hanging pants and similar garments foldable in two parts is composed of a rigid frame which is provided with a central hook and in the lower part thereof with a rod, the rod being intended to support the garment folded in two parts. The device is characterized by the fact that the frame (1) is formed of a cross-piece (2) and uprights (3) at the extremities, the cross-piece (2) being located at the extremities of the uprights, which act as a guide for the rod (4). The rod is capable of moving along the uprights to be in a lower position and in a raised position in contact with the cross-piece. The blocking of the rod in different positions is achieved by means of a joint of the saw type with teeth which is unidirectional and the toothed surface (5) is located on each of the uprights while the toothed spike is formed on the sleeve (7) which serves as a guide for the rod.

8 Claims, 3 Drawing Sheets

DEVICE FOR SUSPENDING PANTS AND SIMILAR GARMENTS FOLDABLE IN TWO PARTS

FIELD OF THE INVENTION

The present invention relates to a device particularly suitable for suspending pants and similar garments foldable in two parts.

BACKGROUND OF THE PRIOR ART

Devices of the type called "appendipantaloni" are known constituted by a rigid frame provided with a central hook. The hook comprises in the lower part a rod intended to support the garment to be suspended, folded in two parts, for pants or similar items of clothing.

The use of this type of device to hang clothing has the drawback that the garment being suspended may fall due to the fact that the same slides from the rod due to the difference in weight of the two opposite parts of the garment in which the garment is folded on the rod. At the present state of the art, the blocking of the garment which is hung on the supporting rod of the device, particularly during the transport of the garments which are hung, from the storage place to the store in which the garments are sold at retail, is carried out in different manners, all of which are based on the use of a further constructive element which provides to compress a portion on the supporting rod, for instance by using a flexible wire placed on the side of the rod or by causing the garment to be partially wound on two rods opposite one to the other and placed close one to the other.

SUMMARY OF THE INVENTION

An object of the present invention is to provide a device for suspending pants and similar garments of the type "appendipantaloni" which offers advantages, from the constructive point of view as well as in the utilization with respect to similar known devices. In particular, the device according to the present invention offers a structure easily producible by press-work and allows the user to carry out the operation of blocking of the garment which has been hung on and the subsequent operation of unblocking the same garment in a rapid and simple manner. Essentially these advantages are achieved by providing that the rod instead of being constituted by a rigid body with the frame located above it as shown in known devices, is movable with respect to the frame and in addition is capable of sliding vertically in a manner to be placed in a detached position in order to allow the garment folded into two parts to rest on it and then allowing the rod to come in contact with the body of the frame so that the garment remains blocked between the frame and the rod.

The invention is further characterized by the fact that the constructive solution which allows the blockage in different positions of the rod and which becomes a means of hooking and unhooking is a ratchet gear with a joint of the type with teeth of a saw.

BRIEF DESCRIPTION OF THE DRAWINGS

The novel features of the invention are more clearly shown by reference to the description of two possible embodiments of the invention which are provided for the purpose of illustrations and which are not intended to be limiting by reference to the accompanying drawings of which.

Figure 1:
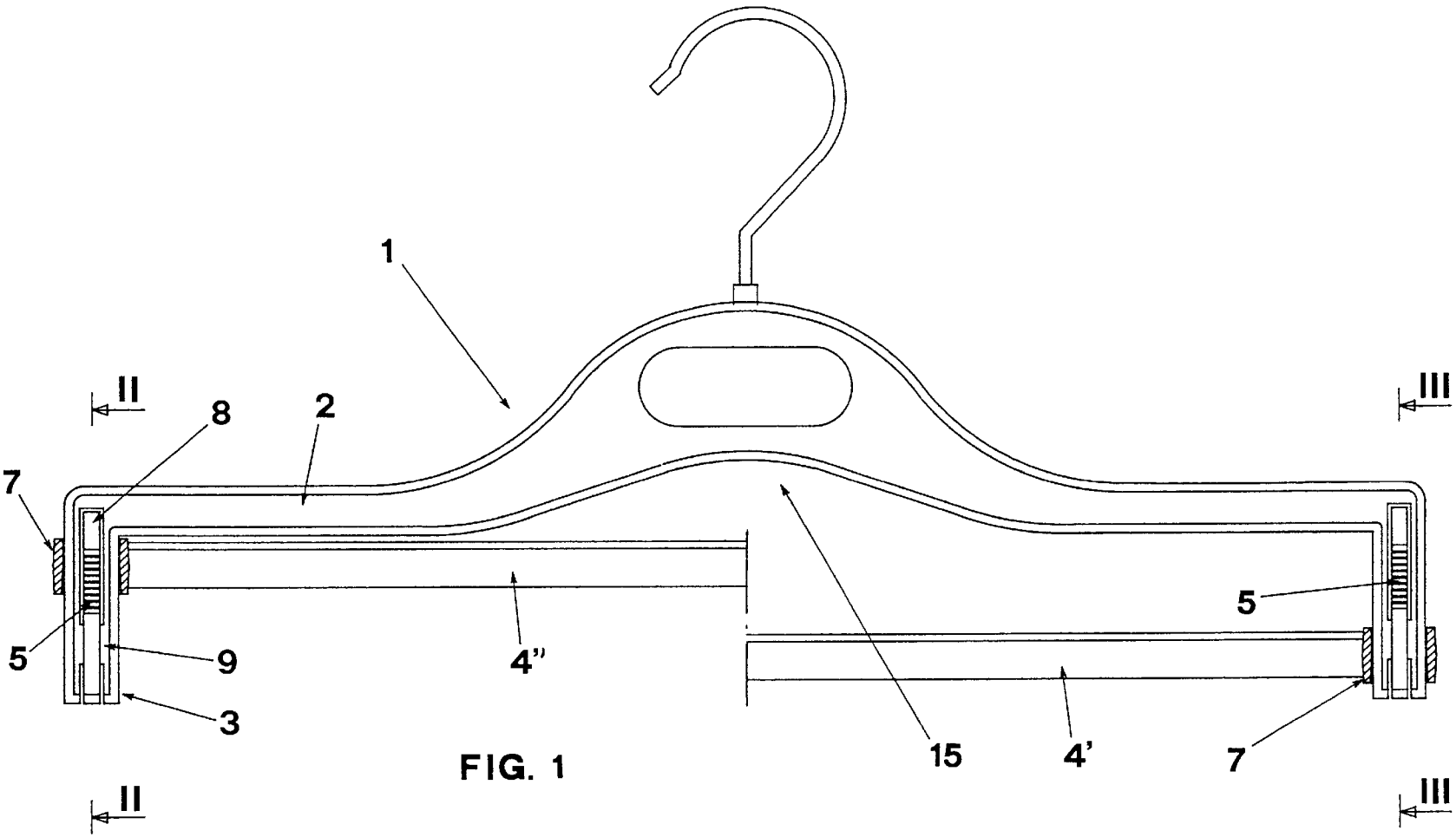
FIG. 1 is an elevational front view of the device of the invention with the movable rod in the two extreme positions.

By reference particularly to FIG. 1 the device according to the present invention comprises frame (1) which is constituted by cross-piece (2), the latter being provided at both extremities with an upright (3), the uprights acting as a guide for the rod (4) on which the garment is placed, the garment being folded in two parts, the garment not being shown in the figures.

The rod (4) is movable and capable of sliding vertically in such a manner that the user may rest the folded garment in the lowermost position 4' and afterwards the user may move the rod (4) to the higher 4" position so that in this manner the garment remains blocked between the support rod and the upper cross-piece (2) of the frame and in this manner the accidental sliding of the garment is prevented.

The anchoring of the movable rod (4) on the uprights (3) which serve as a guide is achieved by means of a joint with teeth of the saw type in which the toothed surface (5) is formed on the upright, while the tooth which serves as a spike (6) is formed on the sleeve (7) which serves as a guide for the same rod. In this manner the result is that the joint is unidirectional allowing only the motion of the rod upwardly.

Figure 8:
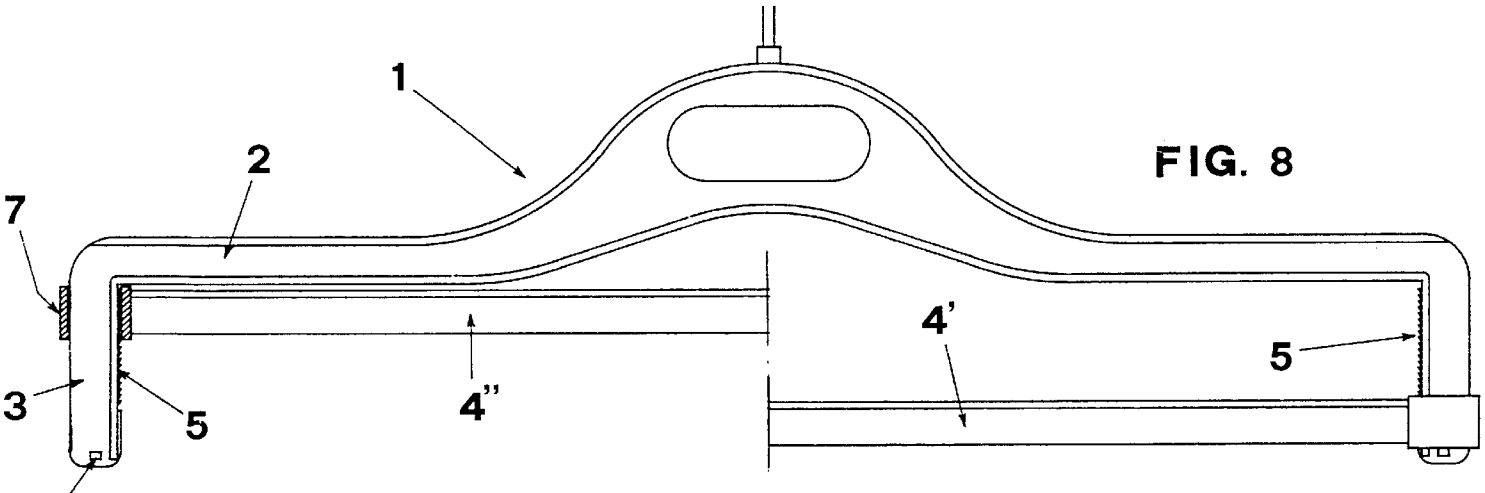
FIG. 8 illustrates a front view of a second embodiment of the device of the invention with the movable rod in the two extreme positions.

FIGS. 1 and 8 show two possible embodiments of the device of the invention which differ substantially for the different system of unhooking of rod (4) from the two uprights (3) in order to allow the lowering of the rod.

According to the first embodiment of the invention illustrated in FIGS. 1–7 the unhooking is carried out by acting manually directly on the two toothed surfaces (5) so that the corresponding spikes (6) are set free and this allows the rod (4) which supports the garment to slide downwardly due to the force of gravity.

Constructively the toothed surface (5) is formed on the flexible tongue (8) which is placed in the interior of the body of the upright and which is integral with it by means of a connecting rib (9).

Figures 2, 3, 4, 5, 6, 7:
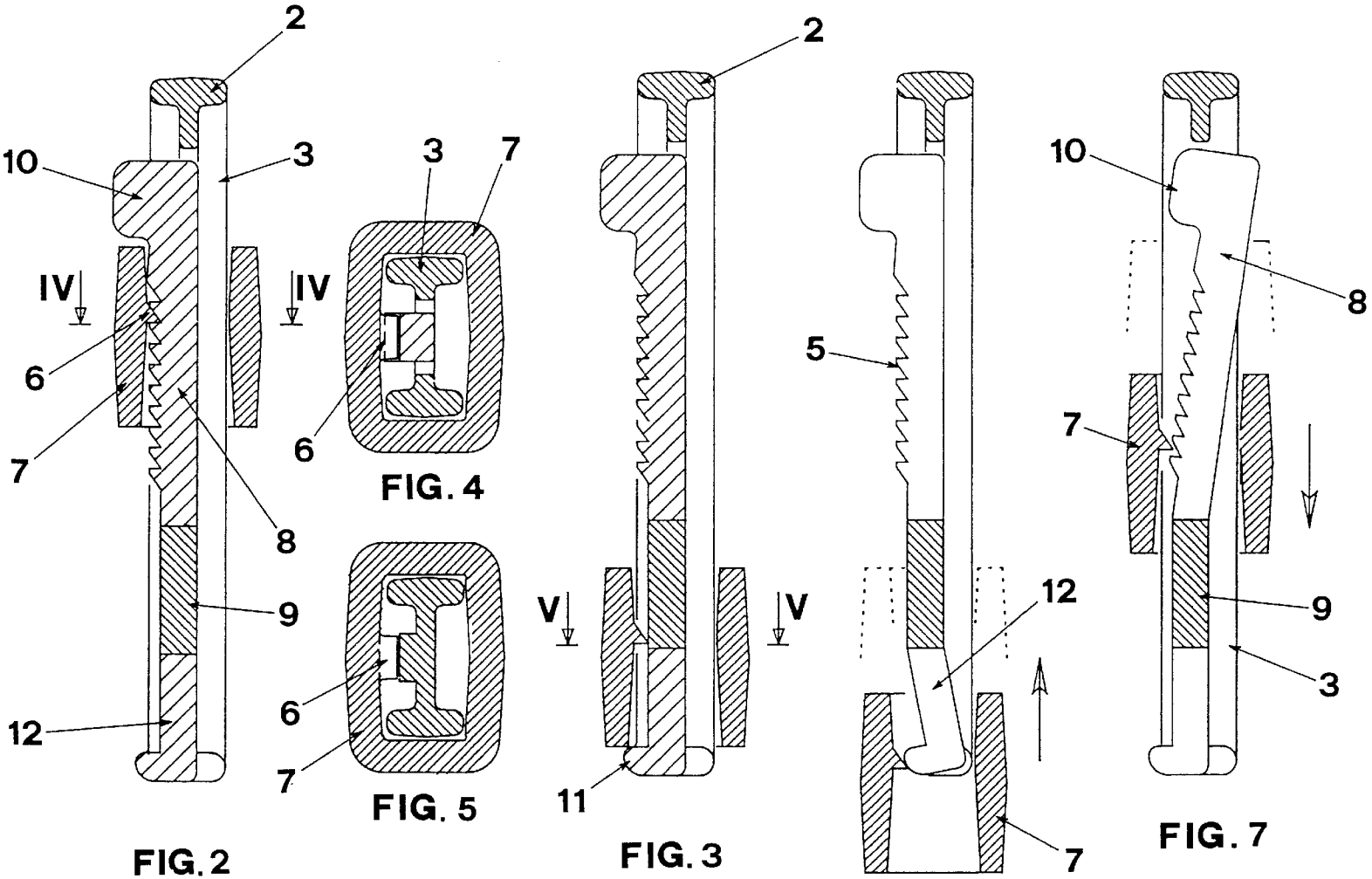
FIG. 2 shows a view of the extremity of the device in cross-section according to line II—II of FIG. 1 with the rod in the uppermost position.
FIG. 3 is a view of the extremity of the device of the invention in cross-section according to line III—III of FIG. 1 with the rod in the lowermost position.
FIG. 4 is a plan view in cross-section according to line IV—IV of FIG. 2 of the system of hooking the rod with the frame.
FIG. 5 is a plan view in cross-section according to line V—V of FIG. 3 of the system of the joint between the rod and the frame.
FIG. 6 is a view of the extremity of the device during the phase of insertion of the rod.
FIG. 7 is a view of the extremity of the device during the phase of unhooking of the rod.

The flexible tongue (8) is provided in the upper part with a projecting clue (10) which facilitates for the user the pushing action necessary to incline the tongue and unhooking the rod from the spike (6) as shown in FIG. 7. Each upright (3) ends with a projecting profile (11) which blocks the sleeve (7) and prevent the free fall of the rod as shown in FIG. 3.

According to this first embodiment of the invention there is provided that another flexible tongue (12) be applied in the lower part of rib (9) so that by allowing the tongue to fold itself the insertion of the sleeve (7), that is the mounting of the rod (4) on frame (1) as shown in FIG. 6.

Figure 9:
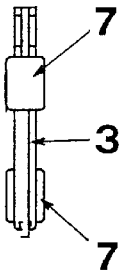
FIG. 9 shows a side view of the device of FIG. 8.
Figure 10:
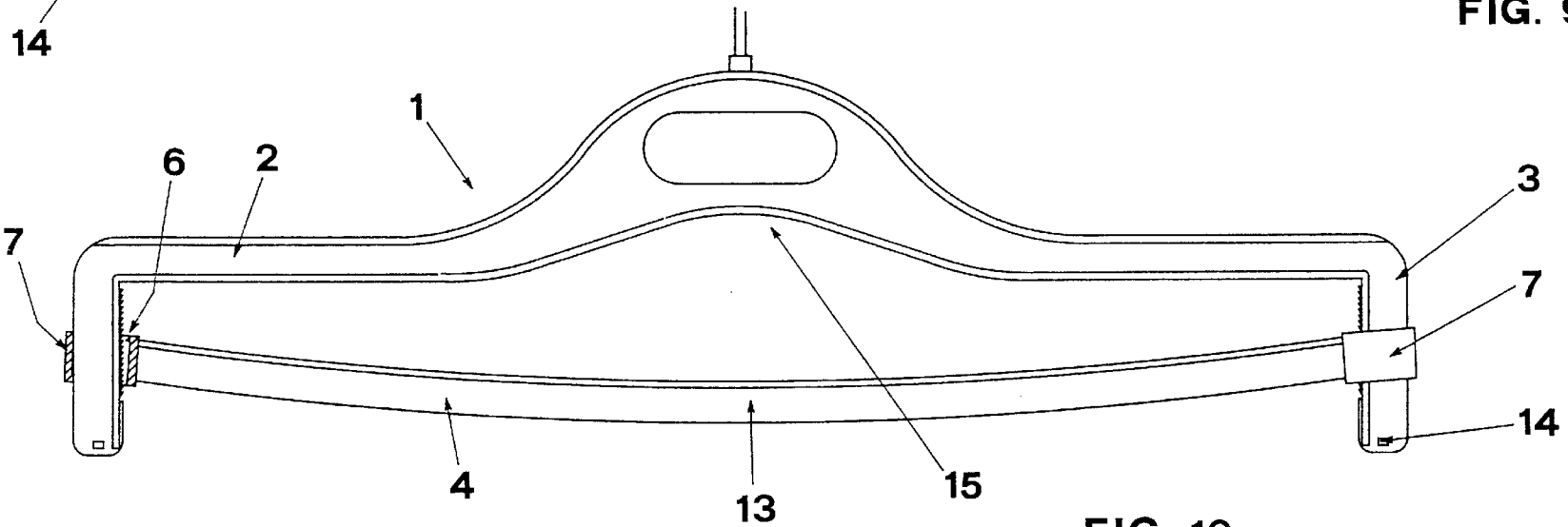
FIG. 10 shows the device of FIG. 8 with the movable rod in the unhooking position.

The second embodiment of the invention shown in FIGS. 8, 9 and 10 permits to support garments of light weight and is constructively simpler that the first embodiment because the toothed surface (5) is directly formed on the frame. The unhooking of the joint is carried out by curving the central part (13) of the rod so that a partial rotation of the two sleeves (7) towards the interior is achieved as shown in FIG. 9, an operation which the user may carry out, for instance, by drawing the garment downwardly.

There are also provided projecting notches (14) which are placed in the lower part of the uprights (3) and which block the motion of the rod downwardly.

Finally in order to allow a good blocking of the garment the cross-piece (2) in the central position has a reentering profile (15) which permits to compensate the greater thickness of the garment, specifically in pants due to seams.

What is claimed is:

1. A device for suspending pants and similar garments, said pants and garments being foldable in two parts, said device comprising a rigid frame, said frame being provided with a central hook and being provided in the lower part thereof with a movable rod, said rod being intended to support said pants and similar garments folded in two parts, wherein said frame (1) comprises a cross-piece (2) and uprights (3), said cross-piece (2) being provided at the extremities thereof with said uprights (3), said uprights (3) acting as a guide for the rod (4), said rod being capable of sliding along said uprights to be in a lower position (4') and in an upper position (4") in contact with said cross-piece (2) and the device also comprises means for blocking said rod (4) on said uprights (3), in different positions, said means comprising a joint and a spike (6), said joint being provided with teeth of the saw type, said joint being unidirectional, the teeth forming a tooth surface (5), each of the toothed surfaces (5) being located in each of said uprights, while each of the toothed spikes (6) is formed on a sleeve (7), each of the said sleeves guiding said rod (4).

2. The device according to claim 1 wherein each of said toothed surfaces (5) is formed on a flexible tongue (8), each of said flexible tongues (8) being integral with each of the said uprights by means of a rib (9), said rib being placed at the base of said uprights.

3. The device according to claim 1, wherein said flexible tongue (8) is capable of inclination whereby said toothed spike (6) is unhooked and said rod (4) is lowered due to the force of gravity.

4. The device according to claim 1, wherein each of the uprights (3) ends with a projecting profile (11), said projecting profile preventing said rod (4) from falling downwardly.

5. The device according to claim 2, wherein a second flexible tongue (12) is anchored on said rib (9), said flexible tongue (12) being capable of folding itself to allow the insertion of said sleeve (7) and said upright (3) when said rod (4) is being mounted on frame (1).

6. The device according to claim 1, wherein the unhooking of said spike (6) from said toothed surface (5) is achieved by curving the central part (13) of said rod (4) whereby a partial inclination of said two sleeves (7) is achieved.

7. The device according to claim 6, wherein the device is provided with projecting notches (14) located on the lower part of said uprights (3), said notches preventing the motion of said rod downwardly.

8. The device according to claim 1, wherein each of said uprights (3) of said frame is provided in the central position with a reentering profile (15).

* * * * *